United States Patent [19]

Hamburger

[11] 4,203,626

[45] May 20, 1980

[54] ARTICULATED BOOM-DIPPER-BUCKET ASSEMBLY FOR A TUNNEL BORING MACHINE

[73] Assignee: Zokor Corporation, Aurora, Ill.

[73] Assignee: Zolor Corporation, Aurora, Ill.

[21] Appl. No.: 13,523

[22] Filed: Feb. 21, 1979

[51] Int. Cl.[2] ..... E21D 9/08

[52] U.S. Cl. ..... 299/33; 299/18; 299/67; 405/144

[58] Field of Search ..... 299/31, 33, 67, 64, 299/18

[56] References Cited

U.S. PATENT DOCUMENTS

| | | | |
|---|---|---|---|
| 3,332,721 | 7/1967 | Samoilov et al. | 299/33 |
| 3,404,920 | 10/1968 | Tabor | 299/31 |
| 3,556,599 | 1/1971 | Fikse | 299/67 X |
| 3,612,609 | 10/1971 | Reuls | 299/33 |
| 3,966,256 | 6/1976 | Fikse | 299/33 |

FOREIGN PATENT DOCUMENTS

| | | | |
|---|---|---|---|
| 1658764 | 4/1970 | Fed. Rep. of Germany | 299/33 |

*Primary Examiner*—Ernest R. Purser
*Attorney, Agent, or Firm*—John C. Brezina

[57] ABSTRACT

The articulated boom-dipper-bucket assembly is utilized in a tunnel boring machine of the type which includes a hollow cylindrical body with a front circular cutting edge and a central axis on which an excavator including the assembly is positioned. The assembly includes a base having a front face facing axially of the machine and being mounted on a bulkhead having side-rails which are received in channels fixed to the body and extending parallel to the central axis. A piston and cylinder mechanism is associated with the bulkhead for reciprocating same in a direction parallel to the central axis. The assembly further includes a boom having one end pivotally mounted to the front face of the base at one side thereof and a second end positioned outwardly from the base, an elongate dipper member pivotally mounted at a first inner end to the second outer end of the boom, and a bucket-scoop having an inner edge and an outer cutting edge and being pivotally mounted to a second outer end of the dipper member. The assembly also includes a mechanism for rotating the base on the bulkhead, a first reciprocal power mechanism pivotally connected at one end to the front face of the base at the other side thereof and pivotally connected at the other end to the boom at a point spaced from the first end thereof, a second reciprocal power mechanism pivotally connected at one end to the first end of the boom and at the other end to the first end of the dipper member and a third reciprocal power mechanism pivotally connected at one end to the first end of the dipper member and at the other end to the inner edge of the bucket-scoop.

12 Claims, 4 Drawing Figures

ARTICULATED BOOM-DIPPER-BUCKET ASSEMBLY FOR A TUNNEL BORING MACHINE

BACKGROUND OF THE INVENTION

1. Field of the Invention

The field of the invention is tunnel boring machines. More specifically, the present invention relates to a tunnel boring machine having an articulated excavator and a breast plate assembly.

2. Description of the Prior Art

Heretofore various types of tunnel boring machines have been proposed for digging a tunnel through material of intermediately hardness and containing loose earth and rock. Such tunnel boring machines typically include a heavy style hollow cylindrical body having a front circular cutting edge and a central axis. An excavator is mounted at the front end of the machine within the cylinder and generally on the central axis of the machine. A conveyor is mounted within the cylindrical body with a loading end thereof situated adjacent the bottom portion of the circular cutting edge. The excavator is operable to cut through material at the front of the machine and move it onto the conveyor.

At the back of the machine mechanisms are provided for positioning quarter-cylindrical precast concrete segments in a circular ring behind the cylindrical body to form an increment of tunnel liner behind the machine.

In the tunnel behind the tunnel boring machine there is mounted a track on which flat cars containing concrete segments can travel to bring segments to the tunnel boring machine and on which gondola cars can travel to the machine for receiving material from the conveyor and carrying the material out of the tunnel.

In digging a tunnel, the tunnel boring machine is positioned at the front of the beginning portion of a tunnel liner. Retractable jack assemblies each including a plurality of jacks are located at the read edge of the cylindrical body and positioned between the rear edge and the front edge of the tunnel liner being formed. The jacks are then extended in increments to force the front circular cutting edge against the material being excavated.

Also, the excavator is operated to remove the material at the front end of the cylindrical body. After an amount of material has been dug out by the excavator and placed on the conveyor, the jacks are extended to push the cutting edge against the material at the outer periphery of the hold being dug by the excavator to finish the cut of the hold to form the tunnel. After the jacks have been extended a predetermined distance, at least equal to the width of the precast quarter-cylindrical segments, the jacks are contracted and the jack assemblies are retracted. Then four concrete segments are positioned in a ring in the space vacated by the retracted jack assemblies the cylindrical body and against the front edge of the tunnel liner.

Next, the jack assemblies are positioned in the space between the new front edge of the liner formed by the four concrete segments just laid in place and the excavator is operated again to dig a hole in the material at the front of the tunnel boring machine. The jacks are periodically extended to push the cylindrical body member toward the hole being dug and to finish the cut of the hole at the outer periphery thereof.

The procedure described above is repeated over and over again until the tunnel is completed.

To prevent material from falling into the front end of the tunnel boring machine as the excavator is digging out the material at the front of the machine, a plurality of breast plates are provided hingedly connected to the inner periphery of the cylindrical body. Typically, such breast plates are arranged in an assembly to form a partially annular shield beneath the top portion of the circular cutting edge of the cylindrical body and above the excavator. Piston and cylinder assemblies are associated with the breast plates for pivoting the breast plates upwardly to hold material from falling into the machine.

Heretofore the excavators often included a bucket-boom assembly comprising a bucket-scoop pivotally mounted at the front end of a boom which is mounted to a bulkhead that can be reciprocated along the central axis of the machine. The boom is rotatable 360° about the central axis and is pivotally mounted to the bulkhead. The assembly includes two reciprocal power mechanisms, one for pivoting the boom about the central axis and another for pivoting the bucket-scoop about the outer end of the boom. In this way four degrees of movement of the excavator are provided which are as follows: (1) reciprocal movement of the boom along the central axis of the cylindrical body; (2) rotation of the boom about the central axis (3) pivoting movement of the boom to move the outer end thereof toward and away from the central axis and; (4) pivotal movement of the bucket-scoop about the outer end of the boom.

With this type of excavator, a large breakout force is obtained at the center of the hole in the material being dug out by the bucket-boom assembly. However, only about half of that breakout force is obtained at the periphery of the hole being dug.

As will be explained in greater detail hereinafter, the articulated boom-dipper-bucket assembly of the present invention provides an excavator which has five degrees of movement with the addition of a dipper member to the assembly. With five degrees of motion, a more uniform breakout force is obtained across the radial extent of movement of the bucket-scoop of the excavator from the central axis of the machine to the circular cutting edge of the machine.

SUMMARY OF THE INVENTION

According to the invention there is provided an articulated boom-dipper-bucket assembly for a tunnel boring machine of the type which includes a hollow cylindrical body having a front circular cutting edge and a central axis, an excavator including a bulkhead, mounting means for mounting the bulkhead on the central axis of the cylindrical body, moving means associated with the excavator for moving the bulkhead axially of the cylindrical body, and rotating means for rotating the excavator 360° about an axis coaxial with or parallel to the central axis, said assembly forming part of the excavator and including a base mounted on the bulkhead and having a front face facing axially toward the front of said machine, an elongate boom having a first inner end pivotally mounted to said base at one side thereof, an elongate dipper member pivotally mounted at a first end thereof to an outer second end of said boom and a bucket-scoop having an inner edge and an outer cutting edge and being pivotally mounted to a second outer end of said dipper member, first reciprocal power means pivotally connected at one end to said base at the other side thereof opposite said one side and pivotally connected at the other end to said boom at a point spaced from said inner end of said boom for moving said outer end of said boom about the pivot connection thereof to said base toward and away from said base, second reciprocal power means pivotally connected at one end to said first end of said boom and pivotally connected at the other end to said first end of said dipper member for moving said dipper member about the pivot connection thereof to said boom toward and away from the central axis of the cylindrical body and third reciprocal power means pivotally connected at one end to said first end of said dipper member and pivotally connected at the other end to said bucket-scoop and operable to pivot said bucket-scoop about the pivot connection thereof to said dipper member to move said outer cutting edge in a clawing action against material being removed by the tunnel boring machine.

DESCRIPTION OF THE PREFERRED EMBODIMENTS

Figure 1:
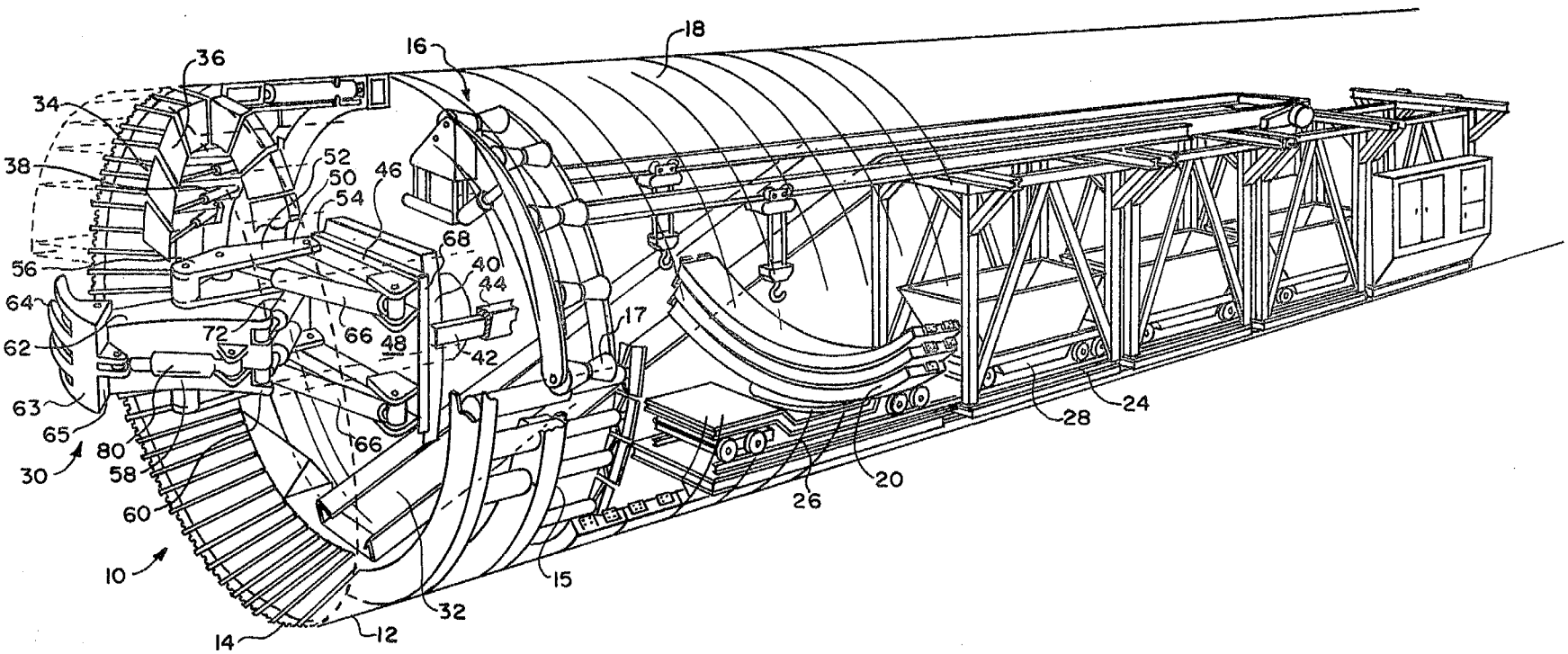
FIG. 1 is a perspective view with portions broken away of a tunnel boring machine utilizing one embodiment of the articulated boom-dipper-bucket assembly of the present invention.

Referring now to the drawings in greater detail, there is illustrated in FIG. 1 a tunnel boring machine 10 for tunneling through material of intermediate hardness. As shown, the machine 10 includes a hollow cylindrical body 12 having a front circular cutting edge 14 and a rear edge 15. One of several jack assemblies 16 comprising a plurality of jacks 17 is shown positioned between the rear edge 15 of the cylindrical body 12 and the front edge of a tunnel liner 18 which is formed in increments from quarter-cylindrical precast concrete segments 20.

As the tunnel boring machine 10 digs out the material at the front end of the machine, the jacks 17 are operated to push the cutting edge 14 against the periphery of the hole being dug to finish the "cut" of the cylindrical hole. Then after the jacks 17 have been fully extended, they are contracted and then the jack assemblies 16 are retracted from the position shown so that four of the concrete segments 20 can be positioned in a ring to form another increment of the tunnel liner 18. The the jack assemblies 16 are repositioned between the rear edge 15 and the front edge of the tunnel liner 18 for pushing the tunnel boring machine 10 against the material through which the machine is tunneling.

As the tunnel is built, generally in the manner briefly described above, a track 24 is laid in the tunnel for carrying flat cars 26 that carry concrete segments 20 to the machine 10 and for carrying gondola cars 28 that are used to haul away material as it is excavated from the front of the tunnel.

As shown in FIG. 1, the machine 10 also includes an excavator 30 which is mounted at the front end of the machine 10 and a conveyor 32 for conveying excavated material from the bottom front of the machine 10 upwardly to a position over the forwardmost gondola car 28.

To prevent material from falling into the machine 10 as the excavator 30 is digging a hole in the material at the front end of the machine 10, a breast plate assembly 34 comprising a plurality of breast plates 36 is mounted at the top front of the machine adjacent to and beneath the upper portion of the cylindrical cutting edge 14 and above the excavator 30. As shown, each of the plates 36 has a generally trapezoidal shape. The plates can be pivoted downwardly to form a partially annular shield as shown in FIG. 1 by piston and cylinder assemblies 38.

According to the teachings of the present invention, the excavator 30 is constructed and arranged to have five degrees of movement.

As shown in FIG. 1 the excavator 30 includes a bulkhead 40 which has a rail 42 mounted on each side thereof. Each of the rails 42 is received within a channel member 44 fixed within and to the cylindrical body 12. A piston and cylinder assembly (not shown) is provided for reciprocating the bulkhead 40 with the rails 42 sliding in the channels 44. Mounted to the bulkhead 40 is a base 46 having a front face 48 which faces axially toward the front of the machine. A mechanism (not shown) is provided for rotating the base 360° in a plane normal to the central axis of the cylindrical body 12. A first inner end 50 of a boom 52 is pivotally mounted to the base 46 adjacent one side 54 thereof.

A second outer end 56 of the boom 52 is pivotally connected to an elongate dipper member 58 at a location between a first inner end 60 of the dipper member 58 and a second outer end 62 of the dipper member 58. Pivotally mounted to the second end 62 of the dipper member is a bucket-scoop 13 having the general shaft of a claw with a front cutting edge 64 and an inner edge 65.

A first pair of boom piston and cylinder assemblies 66 are each pivotally connected at a first end to the base 46 at a side 68 thereof opposite the side 54 of the base 46. A second or outer end of each piston and cylinder assembly 66 is pivotally connected to the boom 52 at a point intermediate the ends 50 and 56 thereof.

A second pair of dipper piston and cylinder assemblies 72 are pivotally connected at one end to the inner end 50 of the boom 52 and at the other end to the inner end 60 of the dipper member 58.

Another bucket piston and cylinder assembly 80 is pivotally connected between the inner end 60 of the dipper member 58 and the inner edge 65 of the bucket-scoop 63.

It will be apparent from the description of the excavator 30 and the bucket-dipper-boom assembly thereof shown in FIG. 1 that five degrees of motion are provided with the excavator 30.

The first degree of motion is the reciprocal motion provided by the power mechanism for reciprocating the bulkhead in the channels 44. This movement provides an in and out movement of the excavator 30 along the central axis of the cylindrical body 12.

A second degree of movement is provided by the rotational mounting of the base 46 on the bulkhead 40.

A third degree of movement is provided by the boom piston and cylinder assemblies 66 which provide for movement of the outer end 56 of the boom 52 to and away from the central axis.

A fourth degree of movement is provided by the dipper piston and cylinder assemblies 72 which provide pivoting movement of the dipper member 58 about the outer end 56 of the boom 52.

Finally, a fifth degree of movement is provided by the bucket piston and cylinder assembly 80 which provides pivotal movement of the bucket-scoop 63 about the outer end 62 of the dipper member 58.

Figure 2:
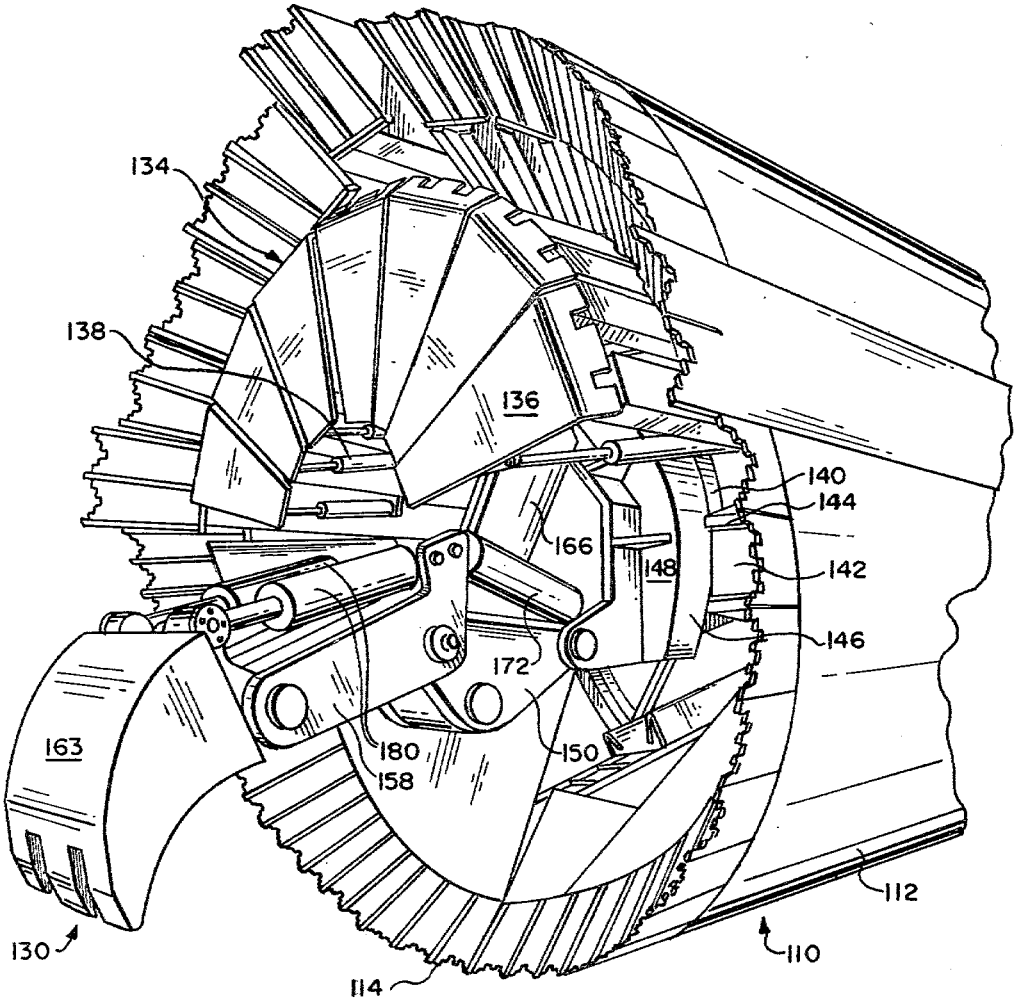
FIG. 2 is a larger perspective view of the front end of the tunnel boring machine shown in FIG. 1 with another embodiment of the articulated boom-dipper-bucket assembly of the present invention shown therein.
Figure 3:
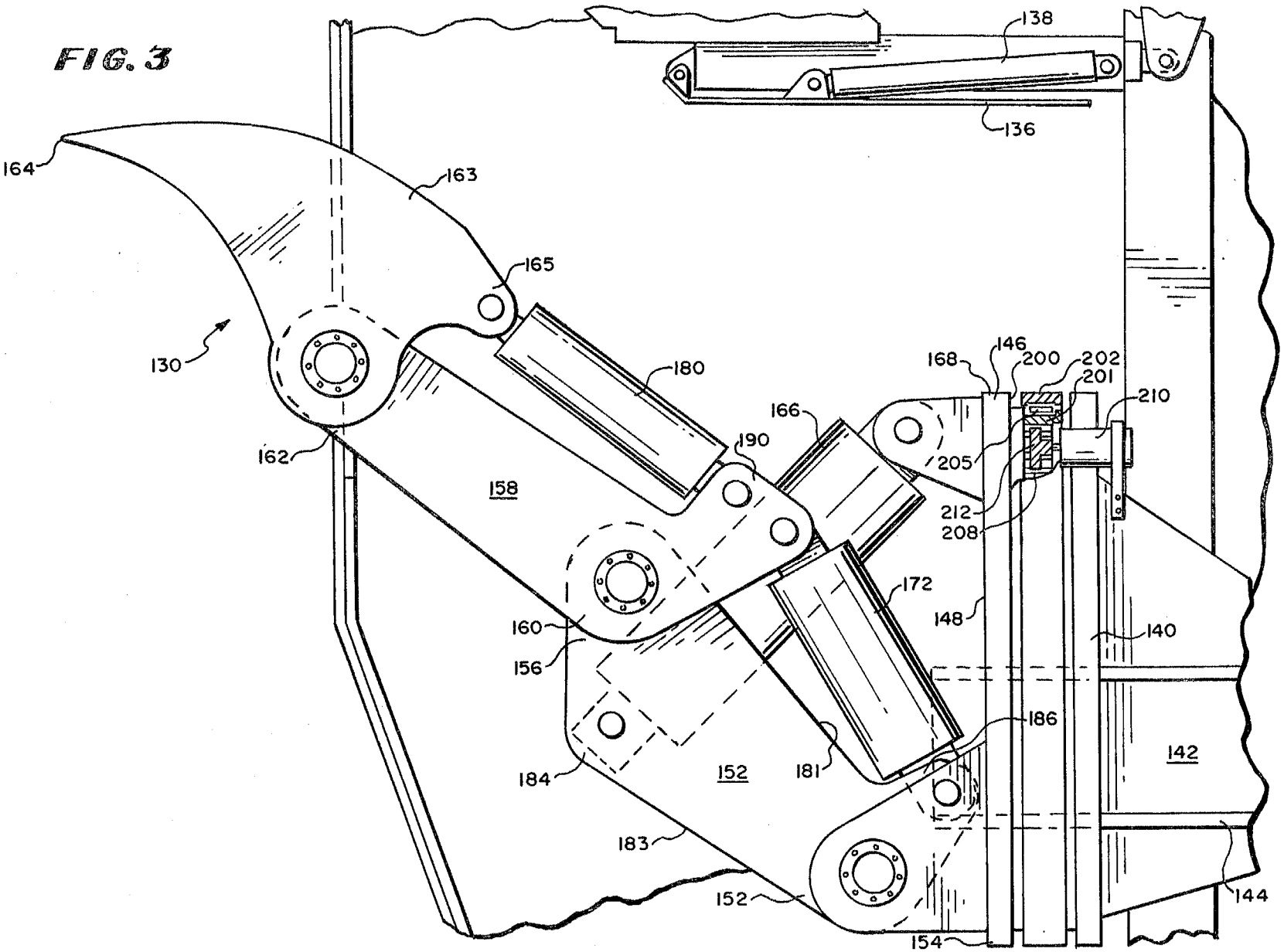
FIG. 3 is a fragmentary vertical side view with portions broken away of the embodiment of the boom-dipper-bucket assembly shown in FIG. 2 with the assembly in a bucket-raised position.

Referring now to FIGS. 2 and 3 there is illustrated therein a modified embodiment of the tunnel boring machine shown in FIG. 1. In this modified ebodiment, the tunnel boring machine is generally identified by the reference numeral 110 and includes a cylindrical body 112 having a front cylindrical cutting edge 114. An excavator 130 similar to the excavator 30 is mounted within the body 112 on the central axis thereof. Also, a breast plate assembly 134 similar to the breast plate assembly 34 is provided. The assembly 134 includes a plurality of generally trapezoidal shaped breast plates which can be pivoted downwardly to the position shown in FIG. 2 by piston and cylinder assemblies 138 to form a partially annular shield for preventing material from falling into the machine 110. Further details of the construction and operation of the breast plate assembly 134 can be found in copending application Ser. No. 13,724 filed on Feb. 21, 1979 and entitled: BREAST PLATE ASSEMBLY FOR A TUNNEL BORING MACHINE, the disclosure of which is incorporated herein by reference.

In this embodiment the construction and arrangement of the various parts of the excavator 130 are slightly different from the construction and arrangement of the parts of the excavator 30 shown in FIG. 1. As shown, the excavator 130 includes a bulkhead 140 having a rail 142 mounted on each side thereof. Each of the rails 142 is received within and slidably movable within one of two channel members 144 positioned on either side of the bulkhead 140 and fixed within the cylindrical body 112. Mounted on the bulkhead is a base 146 having a front face 148 which faces axially outwardly toward the front of the machine 110. A first inner end 150 of a boom 152 is pivotally connected to the front face 148 of the base 146 adjacent one side 154 of the base 146. A second outer end 156 of the boom 152 is pivotally connected to an elongate dipper member 158 at the inner end 160 thereof. A second outer end 162 of the dipper member 158 is pivotally connected to a bucket-scoop 163 having an outer cutting edge 164 and an inner edge 165.

A single boom piston and cylinder assembly 166 is pivotally connected at one end to the base 146 at a side 168 thereof opposite the side 154. The outer end of the boom piston and cylinder assembly 166 is pivotally connected to the boom 152 at a point between the ends 150 and 156 thereof.

A pair of dipper piston and cylinder assemblies 172 are each pivotally connected at one end to the inner end 153 of the boom 150 and at the other end to the inner end 160 of the dipper member 158.

Finally, a pair of bucket piston and cylinder assemblies 180 is pivotally connected a one end to the inner end 160 of dipper member 158 and at the other end to the inner edge 165 of the bucket-scoop 163.

It will be noted that the major difference between the excavator 130 and the excavator 30 is that the excavator 30 utilizes two boom piston and cylinder assemblies 66 and one bucket piston and cylinder assembly 80 whereas the excavator 130 utilized one boom piston and cylinder assembly 166 and two bucket piston and cylinder assemblies 180.

Also the configuration of the boom 152 and the dipper member 158 differ slightly from the construction of the boom 52 and dipper member 58 of the excavator 30 and these differences will now be described below.

Referring now to FIG. 3, the boom 152 has an inner side 181 which is the closest side of the boom 152 to the base 146 and an outer side 183. The outer side 183 is slightly convex so as to have a projecting portion 184 which is located between the ends 150 and 156 of the boom 152. The pivot connection of the boom piston and cylinder assembly 166 is located in the projecting portion 184 as shown in FIG. 3.

Also the boom 152 has a generally L shaped configuration with an ear formation 186 extending from the inner side 181 of the boom and outwardly from the inner end 150 of the boom 152. As shown, the inner end of the dipper piston and cylinder assemblies 172 is pivotally connected to the ear formation 186.

The dipper member 158 also has a generally L shaped configuration with a short leg 190 extending outwardly from the inner end 160 of the dipper member 158. This short leg 190 is of sufficient width to provide for two pivot connections, one pivot connection being to the outer end of the piston and cylinder assembly 172 and the other pivot connection being of the inner end of the bucket piston and cylinder assemblies 180.

Although the ear formation 180 and short leg formation 190 have been described as a unitary formation, it will be apparent from FIG. 2 that the ear formation 186 actually consists of two ears, one on each side of the boom 152 and the short leg formation 190 of the dipper member actually consists of two legs on either side of the dipper member.

Extending from a back side 200 of the base 146 is a ring 201 which is received within the inner periphery of a cylindrical portion 202 of the bulkhead 140. Positioned between the ring 201 and the cylindrical portion 202 are roller bearings 205 which permit smooth rotation of the base 146 relative to the circular portion 202 of the bulkhead 140.

On the inner periphery of the ring 201 are provided gear teeth 208. Mounted to the bulkhead 140 are two motors one of which, 210, is shown in FIG. 3. Each of the motors 210 has a pinion gear 212 mounted on the shaft thereof in position to engage the gear teeth 208 for rotating the base 146 relative to the bulkhead 140.

With the construction and arrangement of the various components of the excavator 130 as described above, it will be apparent that the excavator 130 also has the same five degrees of movement found in the excavator 30.

Figure 4:
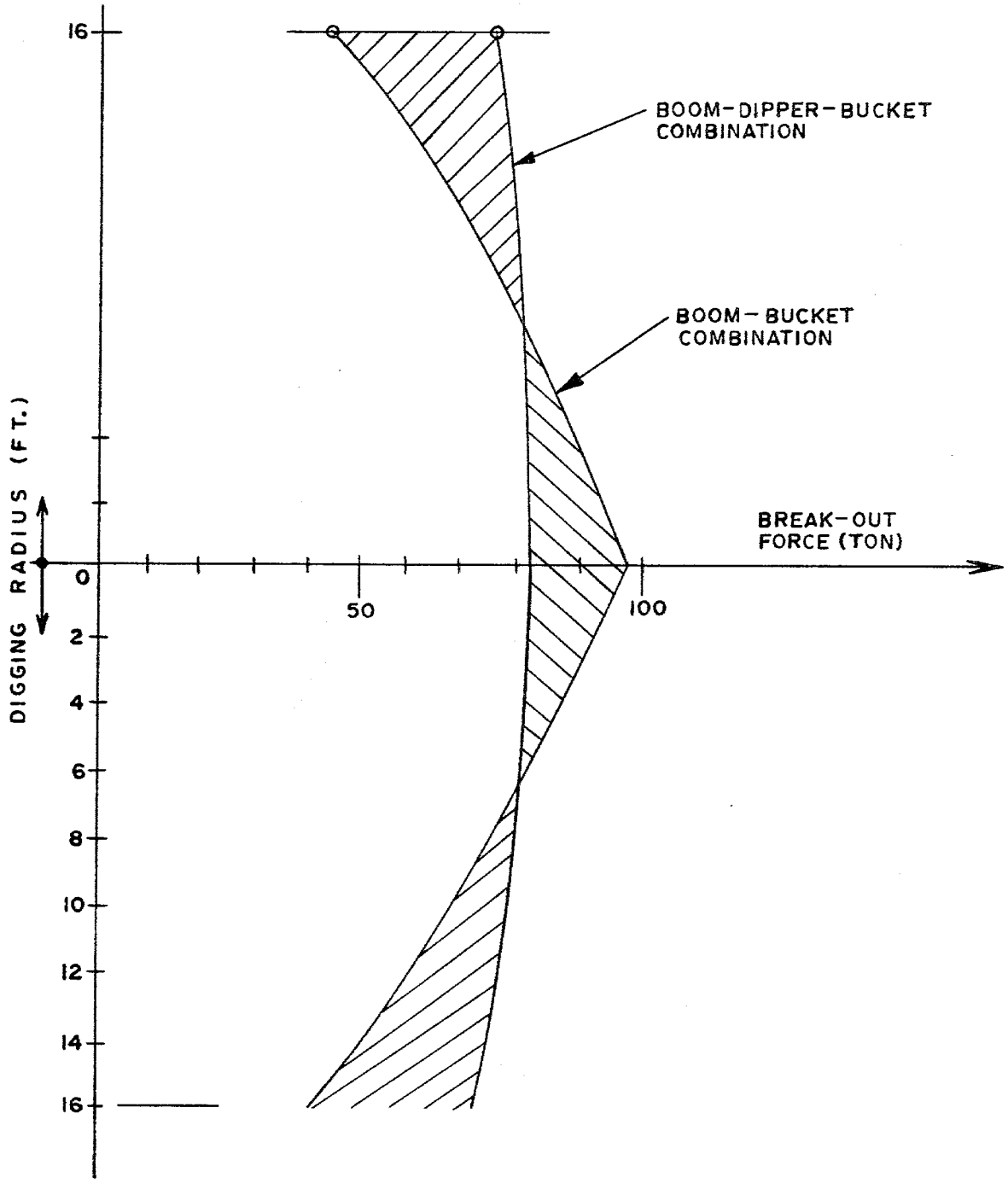
FIG. 4 is a graph comparing the breakout force in tons of a prior art boom-bucket assembly with the breakout force in tons of the articulated boom-dipper-bucket assembly of the present invention.

Empirical tests conducted with the excavator 30 and the excavator 130 have shown that the breakout force at the cutting edge 164 of the bucket-scoop 163 is substantially uniform about the total circular area of movement of the bucket-scoop 163 from the central axis of the cylindrical body 12 radially outwardly to a point near the circumference of the cylindrical body 12. This is best shown in FIG. 4 where the breakout force for a boom-bucket assembly combination of known type is greatest at the center where the breakout force is approximately 97 tons and decreases to roughly 42 tons at the outer radial position of the bucket of the boom-bucket combination which is approximately 16 feet from the central axis.

On the other hand, the breakout force of the boom-dipper-bucket assembly combination of the present invention has a maximum force of roughly 82 tons at the central axis and decreases only slightly to about 75 tons at the outer radial position of the bucket-scoop 63 or 163 of the assembly. Accordingly, a strong and generally uniform breakout force is provided at all of the positions of the bucket-scoop 63 or 163 of the evacator 30 or 130.

It will be apparent that the excavator 30 or 130 of the present invention has a number of advantages some of which have been described above, namely increased breakout force at the outer radius of movement of the excavator 30 or 130, and others of which that are inherent in the invention. Accordingly, the scope of the invention is only to be limited as necessitated by the accompanying claims.

I claim:

1. An articulated boom-dipper-bucket assembly for a tunnel boring machine of the type which includes a hollow cylindrical body having a front circular cutting edge and a central axis, an excavator including a bulkhead, mounting means for mounting the bulkhead on the central axis of the cylindrical body, moving means associated with the excavator for moving the bulkhead axially of the cylindrical body, and rotating means for rotating the excavator 360° about an axis coaxial with or parallel to the central axis, said assembly forming part of the excavator and including a base mounted on the bulkhead and having a front face facing axially toward the front of said machine, an elongate boom having a first inner end pivotally mounted to said base at one side thereof, an elongate dipper member pivotally mounted at a first end thereof to an outer second end of said boom and a bucket-scoop having an inner edge and an outer cutting edge and being pivotally mounted to a second outer end of said dipper member, first reciprocal power means pivotally connected at one end of said base at the other side thereof opposite said one side and pivotally connected at the other end to said boom at a point spaced from said inner end of said boom for moving said outer end of said boom about the pivot connection thereof to said base toward and away from said base, second reciprocal power means pivotally connected at one end to said first end of said boom and pivotally connected at the other end to said first end of said dipper member for moving said dipper member about the pivot connection thereof to said boom toward and away from the central axis of the cylindrical body and third reciprocal power means pivotally connected at one end to said first end of said dipper member and pivotally connected at the other end to said bucket-scoop and operable to pivot said bucket-scoop about the pivot connection thereof to said dipper member to move said outer cutting edge in a clawing action against material being removed by the tunnel boring machine.

2. The assembly according to claim 1 wherein said first reciprocal power means includes two piston and cylinder assemblies, each pivotally mounted at one end to said base and at the other end to said boom.

3. The assembly according to claim 1 wherein said first reciprocal power means include one piston and cylinder assembly pivotally connected at one end to said base and at the other end to said boom.

4. The assembly according to claim 1 wherein said second reciprocal power means includes two piston and cylinder assemblies each of which is pivotally connected at one end to said inner end of said boom and at the other end to said inner end of said dipper member.

5. The assembly according to claim 1 wherein said third reciprocal power means includes two piston and cylinder assemblies each of which is pivotally connected at one end to said inner end of said dipper member and at the other end to said inner edge of said bucket-scoop.

6. The assembly according to claim 1 wherein said reciprocal power means include one piston and cylinder assembly pivotally connected at one end to said inner end of said dipper and at the other end to said inner edge of said bucket-scoop.

7. The assembly according to claim 1 wherein said boom has an L configuration with a short ear formation extending outwardly from an inner side of said boom closest to said base, from the elongate axis of the boom and from said first inner end of said boom, and second reciprocal power means being pivotally connected at said one end thereto to said short ear formation.

8. The assembly according to claim 7 wherein said outer side of said boom opposite said inner side has a convex configuration so as to provide a projecting portion and said other end of said first reciprocal power means is pivotally connected to said projecting portion.

9. The assembly according to claim 1 wherein said dipper member has an L configuration with a short leg formation extending outwardly from the elongate axis of said dipper member and outwardly from said first end thereof, the other end of said second reciprocal power means being pivotally connected to said short leg formation and said one end of said third reciprocal power means being pivotally connected to said short leg formation.

10. The assembly according to claim 1 wherein said bulkhead is generally cylindrical, wherein said base has a generally circular configuration and a reduced in diameter ring which extends from the back side of said base and which is received in said circular bulkhead, and wherein said assembly includes bearing means between the outer periphery of said ring and the inner periphery of said bulkhead.

11. The assembly according to claim 10 wherein said ring has gear teeth on the inner periphery thereof and said rotating means include pinion gear means for engaging said gear teeth on said ring and motor means mounted to said mounting means for rotating said pinion gear means.

12. The assembly according to claim 1 wherein said mounting means include parallel spaced facing channels fixed within and to said cylindrical body, parallel spaced rails which are fixed to opposite sides of said bulkhead and which are received respectively in the channels, and wherein said moving means comprise reciprocal power means for moving said bulkhead back and forth with said rails sliding within said channels.

* * * * *

UNITED STATES PATENT AND TRADEMARK OFFICE

CERTIFICATE OF CORRECTION

PATENT NO. : 4,203,626

DATED : May 20, 1980

INVENTOR(S) : Herman Hamburger

It is certified that error appears in the above—identified patent and that said Letters Patent is hereby corrected as shown below:

On the title page, item [73] second entry should be deleted in its entirety.

Signed and Sealed this

*Twenty-first* Day of *October 1980*

[SEAL]

*Attest:*

SIDNEY A. DIAMOND

*Attesting Officer*

*Commissioner of Patents and Trademark*